US011241805B2

(12) United States Patent
Grunbart

(10) Patent No.: US 11,241,805 B2
(45) Date of Patent: Feb. 8, 2022

(54) RAZOR BASE, RAZOR AND CORRESPONDING USE

(71) Applicant: Manfred Grunbart, Salzburg (AT)

(72) Inventor: Manfred Grunbart, Salzburg (AT)

( * ) Notice: Subject to any disclaimer, the term of this patent is extended or adjusted under 35 U.S.C. 154(b) by 0 days.

(21) Appl. No.: 16/634,144

(22) PCT Filed: Jul. 13, 2018

(86) PCT No.: PCT/EP2018/069172

§ 371 (c)(1),
(2) Date: Jan. 25, 2020

(87) PCT Pub. No.: WO2019/020406

PCT Pub. Date: Jan. 31, 2019

(65) Prior Publication Data

US 2020/0223083 A1 Jul. 16, 2020

(30) Foreign Application Priority Data

Jul. 26, 2017 (EP) ..... 17183311
Mar. 27, 2018 (EP) ..... 18164135

(51) Int. Cl.
*B26B 21/52* (2006.01)

(52) U.S. Cl.
CPC ..... *B26B 21/527* (2013.01)

(58) Field of Classification Search
CPC ..... B26B 21/52; B26B 21/527; B26B 21/528; B26B 21/00; B26B 21/14; B26B 21/22; B26B 21/227; B26B 21/40; B26B 21/521; B26B 21/522
See application file for complete search history.

(56) References Cited

U.S. PATENT DOCUMENTS 1,917,812 A * 7/1933 Robinson ..... B26B 21/527 30/72
1,991,405 A * 2/1935 Merriman ..... B26B 21/18 30/41
D162,933 S * 4/1951 Chambers ..... D28/46
2,704,397 A * 3/1955 Maryc ..... B26B 21/06 30/32
4,809,432 A * 3/1989 Schauble ..... B26B 21/446 222/494
4,850,107 A * 7/1989 Valliades ..... B26B 21/44 30/41
D304,773 S * 11/1989 Beuchat ..... D28/46
(Continued)

FOREIGN PATENT DOCUMENTS

AT 502727 B1 1/2008
GB 2487915 A1 2/2011
WO WO 2013/034902 A1 3/2013

*Primary Examiner* — Ghassem Alie
*Assistant Examiner* — Samuel A Davies

(57) ABSTRACT

The present invention relates to a razor base (2) comprising a head portion (4), wherein the head portion (4) comprises a forward surface (42) and a rear surface (44) opposite to the forward surface (42); and at least one rear extension (6, 60) extending away from the rear surface (44); wherein the rear surface (44) and the at least one rear extension (6, 60) together define finger end receiving sections (8) each configured to receive a finger end section (102) of a user. The present invention also relates to a corresponding razor and to a corresponding use.

13 Claims, 7 Drawing Sheets

(56) References Cited

U.S. PATENT DOCUMENTS

| | | | | | |
|---|---|---|---|---|---|
| 5,335,417 | A * | 8/1994 | Genero | B26B 21/40 | 30/123.3 |
| 5,357,680 | A * | 10/1994 | Monistere | B26B 21/525 | 30/298 |
| 5,537,749 | A * | 7/1996 | Cacioppo | B26B 21/40 | 30/123.3 |
| D386,819 | S * | 11/1997 | Doyle | D28/46 | |
| 6,550,148 | B2 * | 4/2003 | Cecil | B26B 21/22 | 30/50 |
| 6,584,696 | B2 | 7/2003 | Ferraro | | |
| D484,769 | S * | 1/2004 | Cheung | B26B 21/527 | D8/98 |
| D512,795 | S * | 12/2005 | Carpenter | D28/45 | |
| 8,141,258 | B1 * | 3/2012 | Frisch | B26B 21/527 | 30/526 |
| 2002/0050065 | A1 * | 5/2002 | Kludjian | B26B 21/522 | 30/50 |
| 2003/0033717 | A1 | 2/2003 | Cecil | | |
| 2014/0290066 | A1 * | 10/2014 | Woolfson | B26B 21/521 | 30/50 |

* cited by examiner

RAZOR BASE, RAZOR AND CORRESPONDING USE

The present invention generally relates to razors, razor bases and corresponding uses.

Such razors are well known in the art. For example, U.S. Pat. No. 6,584,696 discloses a razor. Such a razor typically comprises a handle and a razor head with blades. The handle and the razor head are connected to one another. Such a razor may be used for shaving. To do so, a user may hold the handle of the razor in their hand, typically contacting the handle with all of their fingers (including the thumb). Other examples of razors or handles for razors are disclosed in AT 502 727 B1 and GB 2487915 A1.

While the discussed razors and handles for razors may be satisfactory in some regards, they have certain drawbacks and disadvantages. For example, they may be cumbersome to use, thereby resulting in shaving results which are far from optimal. In particular, they may only provide insufficient feedback to the user, which may be particularly disadvantageous when the user intends to shave body parts which are hard to reach or which cannot be readily seen by the user during shaving. This may increase the likelihood of the user not completely shaving all the hairs off a body part and/or of the user hurting themselves during the shaving process.

It is an object of the present invention to overcome or at least alleviate the shortcomings and disadvantages of the prior art. In particular, it is an object of the present invention to provide a razor, a corresponding razor base and a corresponding method being improved with regard to handling, shaving results, and user safety.

These objects are met by the present invention.

In a first embodiment, the invention relates to a razor base. The razor base comprises a head portion, wherein the head portion comprises a forward surface and a rear surface opposite to the forward surface. The razor base further comprises at least one rear extension extending away from the rear surface.

That is, instead of having a handle on the rear side, the present invention simply provides one or more rear extensions. The present invention may provide a razor base allowing the user to contact the rear surface of the head portion during shaving directly with their fingers and in particular with their finger end sections. In some configurations, the user may contact the rear surface of the head portion with their finger pads, e.g., with the finger pads of the index finger and the middle finger. This may be advantageous, as the user may directly contact the section of the razor base to which force is applied during shaving.

Furthermore, by using the finger end sections, and in particular the finger pads, the user may use a part of the body being very sensitive to perform the shaving. This may provide an apt feedback of the shaving operation to the user and thereby improve the shaving results, the handling and the user safety.

That is, the invention provides a very sensible supply of a force to a tool, such as a blade unit of a razor. More particularly, the present invention may provide an open sensory fit between the base and the user's fingers. Thus, a very sensitive supply of force may be allowed, and the finger pad may sense the feedback during shaving with its nerve receptors. Thus, a new and improved shaving experience may be provided.

This may allow supplying a shaving force in a direct and finely regulated manner to the region to be shaved. The invention thus provides a razor base (which may also be referred to as a base, a razor support or a razor holder), which allows for a softer, more precise and simpler handling. At the same time, the present invention allows for a direct feedback via skin receptors during shaving.

The rear surface and the at least one rear extension may together define finger end receiving sections each configured to receive a finger end section of a user.

It will be understood that the finger end sections are the finger sections defined by the distal phalanges. Put differently, the finger end sections are the sections of the fingers distal from the distal interphalangeal joints. It will be understood that in embodiments of the present invention, the finger end receiving sections may be configured and sized to only receive the finger end sections, i.e., not to receive any section of the finger of the user proximal to the finger end sections.

Thus, the finger end sections may still move relatively freely by means of the distal interphalangeal joints. This may allow a particularly well suited mobility simply by means of the user's joints. Thus, there is no need for a pivoting mechanism in the razor base or in the corresponding razor, which is why such a pivoting mechanism may be omitted in embodiments of the present invention. Omitting such a pivoting mechanism may lead to minimization of the distance between the finger pad and a blade unit during use, further improving the tactile feedback and thus the shaving results.

Generally, the discussed razor base may be relatively small in size. Such a small size may allow shaving at body parts which are very sensible, hard to reach, and/or hard to see by a user. Furthermore, a small razor base and razor may also allow shaving in small shaving radiuses.

The head portion may be configured to be connected to a blade unit comprising at least one razor blade in a use configuration.

The forward surface may be the portion of the razor base configured to be closest to the at least one blade of a blade unit, when the razor base is connected to the blade unit in a use configuration.

The at least one rear extension may be fixedly connected to the head portion.

This may provide a particularly simple design with few components. Furthermore, it may also contribute to the overall razor base and razor being small in size.

The razor base may be formed in one part.

This may allow for a particularly simple production process. Furthermore, it may also increase the stability (and thus, the fail safety) of the razor base.

The razor base may be injection molded.

In particular, the razor base may be injection molded with a synthetic material and/or silicone technology. In embodiments of the present invention, the razor base may be injection molded in a multi-component injection molding process. This may allow an apt design for receiving the finger end sections.

The razor base may define a contractible space.

The razor base defining a contractible space is meant in the mathematical sense and should denote that the razor base is homotopic to, e.g., a solid sphere, and not, e.g., to a donut shaped element.

This may provide a particularly simple and easy to produce razor base.

The rear surface may be concave.

That is, the rear surface may be inwardly curved.

The forward surface may be convex. That is, the forward surface may be outwardly curved.

The at least one rear extension may comprise a central rear extension.

The central rear extension may be generally heart shaped. This may, together with the shape of the rear surface of the head portion, define suitable finger end receiving sections.

The sections of the at least one rear extension defining the finger end receiving sections may be concave. That is, these sections may be inwardly curved.

Each finger end receiving section may have walls configured to support a finger end section on at least two and preferably three sides.

The head portion may define a longitudinal direction.

The longitudinal direction may be defined by the blades.

The razor base may be mirror symmetric with respect to a symmetry plane.

The symmetry plane may have a normal vector perpendicular to the symmetry plane, and the longitudinal direction may be parallel to the normal vector.

Any (and in some embodiments: all) of the above rationales may be used to define a longitudinal direction.

The central rear extension may have a longitudinal size in the longitudinal direction that varies in dependence of the distance to the rear surface.

This may allow for a suitable design for the finger end receiving sections, and it may allow the user to aptly hold the razor base during shaving by means of their finger end sections.

The central rear extension may comprise a section in which the longitudinal size increases with increasing distance from the rear surface.

That is, the central rear extension may widen in the rear direction.

The razor base may have a rough surface.

This may be suitable for allowing the user to hold the razor base during shaving, and also in wet conditions.

Each finger end receiving section may taper along a finger insertion direction.

This may allow the finger end receiving sections to be well suited for fingers of different shapes, sizes and/or thicknesses.

The at least one rear extension may be generally perpendicular to the head portion.

The central rear extension may overlap the symmetry plane.

That is, the central rear extension may be provided centrally.

The at least one rear extension may comprise lateral rear extensions.

The head portion may comprise a length of 20 to 60 mm, preferably 30 to 50 mm, further preferably 35 to 40 mm, such as 38 mm.

This may allow for a suitable shaving result. In particular, it may be small enough to reach body parts that are hard to reach and to shave in small radiuses.

The head portion may comprise a width of 10 to 40 mm, preferably 15 to 30 mm, further preferably 20 to 25 mm, such as 23 mm.

The head portion may comprise a thickness of 2 to 12 mm, preferably 3 to 7 mm, further preferably 4 to 6 mm, such as 5 mm.

Having such a thin head portion may allow the finger end section to be positioned relatively close to the blades during shaving, and it may contribute to a direct and good feedback to the user during shaving.

The rear surface may be curved around an axis parallel to the longitudinal direction and the rear surface may comprise a radius of curvature in the range of 20 to 50 mm, preferably 30 to 40 mm, further preferably 32 to 38 mm, such as 35 mm The central rear extension may have a varying longitudinal size along the longitudinal direction.

A minimum longitudinal size of the central rear extension may be in the range of 1 to 10 mm, preferably 2 to 6 mm, further preferably 3 to 5 mm, such as 4 mm.

Thus, the finger end sections received in the finger end receiving sections may be positioned relatively close to one another, which may also improve the handling of the razor base.

In some embodiments, a maximum longitudinal size of the central rear extension may be 13 to 25 mm, preferably 15 to 20 mm, further preferably 17 to 19 mm, such as 18 mm.

In other embodiments, a maximum longitudinal size of the central rear extension may be 25 to 35 mm, preferably 28 to 30 mm, such as 29 mm.

The at least one rear extension may comprise a size in the rear direction of 20 to 50 mm, preferably 30 to 40 mm, further preferably 32 to 38 mm, such as 35 mm.

That is, the at least one rear extension may be relatively small in size.

The at least one rear extension may comprise a width of 15 to 40 mm, preferably 20 to 35 mm, further preferably 25 to 30 mm, such as 27 mm.

Again, this relates to the at least one rear extension being relatively small in size, and being distinctively different from handles in the prior art.

The at least one rear extension may only protrude in a width direction with respect to the head portion by 2 to 10 mm, preferably 3 to 7 mm, further preferably 4 to 6 mm, such as 5 mm.

The central rear extension may be curved around a curvature axis generally parallel to an axis of the finger end receiving sections.

The curvature may taper along the curvature axis.

The at least one rear extension may be the central rear extension.

The at least one rear extension may be the lateral rear extensions.

The razor base may have a weight of 8 to 40 g, preferably 10 to 20 g, such as 12 to 15 g. Having such a weight may allow for a suitable handling of the razor base.

The razor base may have a maximum extension of less than 80 mm, preferably less than 60 mm, further preferably less than 50 mm in any direction.

This again highlights the relatively small size of the razor base, allowing the user to use the razor base on body parts that are hard to reach and to use it to shave in small radiuses.

The razor base may comprise 2 finger end receiving sections.

That is, the razor base may comprise exactly 2 (and not more) finger end receiving sections.

The razor base may comprise an anti-slip material. In particular, the sections defining the finger end receiving sections may comprise an anti-slip material on their surfaces. This may improve handling of the razor base also in wet conditions (such as when shaving when showering).

In particular, the razor base may comprise an anti-slip coating. One non-limiting example of such an anti-slip material/coating is EpoSoft, obtainable by Eposint AG in Pfyn, Switzerland.

The razor base may be configured to be rigidly connected to the blade unit.

The present invention also relates to a razor comprising the razor base as discussed above and the blade unit as also discussed above.

The blade unit may be fixedly connected to the head portion.

The blade unit may be removably connected to the head portion.

The at least one razor blade may be distanced from the rear surface by 3 to 12 mm, preferably 4 to 8 mm, further preferably 5 to 7 mm, such as 6 mm.

This may again lead to a very direct and good feedback during shaving.

The blade unit may be rigidly connected to the razor base.

The blade unit may comprise a flushing channel.

The flushing channel may comprise an opening with a height in the range of 0.1 mm to 2 mm, such as 0.2 mm to 1.5 mm and preferably 0.5 mm to 1.0 mm.

The blade unit may comprise a main portion and two boundary portions and the blade unit may surround the razor base on at least three sides.

In use, the at least one razor blade may be distanced from the forward surface of the razor base by a distance not exceeding 5 mm, preferably not exceeding 4 mm, further preferably not exceeding 3 mm, such as 0.1 mm to 1 mm.

The present invention also relates to a use of the razor as discussed above, wherein the use comprises shaving.

During shaving, finger end sections of a user may be located in the finger end receiving sections.

During shaving, the finger end sections may be the only sections of the user's fingers contacting the razor.

Thus, the user may still move the finger end sections around the distal interphalangeal joints, thereby providing a very well controlled movement. This may again improve the shaving results.

The use may comprise finger pads of the user being in contact with the rear surface during shaving.

As the finger pads are very sensitive, this may allow for a particularly good and safe shaving operation.

The use may comprise finger nails of the user being in contact with the rear surface during shaving.

Thus, also another configuration may be possible during shaving. Such a configuration may be particularly useful when intending to shave across the grain.

The shaving may comprise shaving an armpit and/or a pubic region.

During shaving, the central rear extension may be positioned between fingers of the user and wherein during shaving, these fingers may contact the central rear extension.

The use may comprise only two fingers contacting the razor during shaving.

The use may comprise only three fingers contacting the razor during shaving.

In one use embodiment, when the finger nails contact the rear surface during shaving, one of the fingers contacting the razor base may be the thumb. In particular, the finger pad of the thumb may be used to support the rear extension.

The present invention is also defined by the following numbered embodiments.

1. A razor base comprising
   - a head portion, wherein the head portion comprises a forward surface and a rear surface opposite to the forward surface; and
   - at least one rear extension extending away from the rear surface.

2. The razor base according to the preceding embodiment, wherein the rear surface and the at least one rear extension together define finger end receiving sections each configured to receive a finger end section of a user.

3. The razor base according to any of the preceding embodiments, wherein the head portion is configured to be connected to a blade unit comprising at least one razor blade in a use configuration.

4. The razor base according to the preceding embodiment, wherein the forward surface is the portion of the razor base configured to be closest to the at least one blade of a blade unit, when the razor base is connected to the blade unit in a use configuration.

5. The razor base according to any of the preceding embodiments, wherein the at least one rear extension is fixedly connected to the head portion.

6. The razor base according to any of the preceding embodiments, wherein the razor base is formed in one part.

7. The razor base according to any of the preceding embodiments, wherein the razor base is injection molded.

8. The razor base according to any of the preceding embodiments, wherein the razor base defines a contractible space.

The razor base defining a contractible space is meant in the mathematical sense and should denote that the razor base is homotopic to, e.g., to a solid sphere, and not, e.g., to a donut shaped element.

9. The razor base according to any of the preceding embodiments, wherein the rear surface is concave.

10. The razor base according to any of the preceding embodiments, wherein the forward surface is convex.

11. The razor base according to any of the preceding embodiments, wherein the at least one rear extension comprises a central rear extension.

12. The razor base according to any of the preceding embodiments, wherein the central rear extension is generally heart shaped.

13. The razor base according to any of the preceding embodiments and with the features of embodiment 2, wherein the sections of the at least one rear extension defining the finger end receiving sections are concave.

14. The razor base according to any of the preceding embodiments and with the features of embodiment 2, wherein each finger end receiving section has walls configured to support a finger end section on at least two and preferably three sides.

15. The razor base according to any of the preceding embodiments, wherein the head portion defines a longitudinal direction.

16. The razor base according to the preceding embodiment and with the features of embodiment 3, wherein the longitudinal direction is defined by the blades.

17. The razor base according to any of the preceding embodiments, wherein the razor base is mirror symmetric with respect to a symmetry plane.

18. The razor base according to the preceding embodiment and with the features of embodiment 15, wherein the symmetry plane has a normal vector perpendicular to the symmetry plane, and wherein the longitudinal direction is parallel to the normal vector.

19. The razor base according to any of the preceding embodiments and with the features of embodiments 11 and 15, wherein the central rear extension has a longitudinal size in the longitudinal direction that varies in dependence of the distance to the rear surface.

20. The razor base according to the preceding embodiment, wherein the central rear extension comprises a section in which the longitudinal size increases with increasing distance from the rear surface.

21. The razor base according to any of the preceding embodiments, wherein the razor base has a rough surface.

22. The razor base according to any of the preceding embodiments and with the features of embodiment 2, wherein each finger end receiving section tapers along a finger insertion direction.

23. The razor base according to any of the preceding embodiment, wherein the at least one rear extension is generally perpendicular to the head portion.

24. The razor base according to any of the preceding embodiments and with the features of embodiment 11 and 17, wherein the central rear extension overlaps the symmetry plane.

25. The razor base according to any of the preceding embodiments, wherein the at least one rear extension comprises lateral rear extensions.

26. The razor base according to any of the preceding embodiments, wherein the head portion comprises a length of 20 to 60 mm, preferably 30 to 50 mm, further preferably 35 to 40 mm, such as 38 mm.

27. The razor base according to any of the preceding embodiments, wherein the head portion comprises a width of 10 to 40 mm, preferably 15 to 30 mm, further preferably 20 to 25 mm, such as 23 mm.

28. The razor base according to any of the preceding embodiments, wherein the head portion comprises a thickness of 2 to 12 mm, preferably 3 to 7 mm, further preferably 4 to 6 mm, such as 5 mm.

29. The razor base according to any of the preceding embodiments and with the features of embodiment 15, wherein the rear surface is curved around an axis parallel to the longitudinal direction and wherein the rear surface comprises a radius of curvature in the range of 20 to 50 mm, preferably 30 to 40 mm, further preferably 32 to 38 mm, such as 35 mm 30. The razor base according to any of the preceding embodiments and with the features of embodiments 11 and 15, wherein the central rear extension has a varying longitudinal size along the longitudinal direction.

31. The razor base according to the preceding embodiment, wherein a minimum longitudinal size of the central rear extension is in the range of 1 to 10 mm, preferably 2 to 6 mm, further preferably 3 to 5 mm, such as 4 mm 32. The razor base according to any of the 2 preceding embodiments, wherein a maximum longitudinal size of the central rear extension is 13 to 25 mm, preferably 15 to 20 mm, further preferably 17 to 19 mm, such as 18 mm.

33. The razor base according to any of the embodiments 30 to 31, wherein a maximum longitudinal size of the central rear extension is 25 to 35 mm, preferably 28 to 30 mm, such as 29 mm.

34. The razor base according to any of the preceding embodiments, wherein the at least one rear extension comprises a size in the rear direction of 20 to 50 mm, preferably 30 to 40 mm, further preferably 32 to 38 mm, such as 35 mm.

35. The razor base according to any of the preceding embodiments, wherein the at least one rear extension comprises a width of 15 to 40 mm, preferably 20 to 35 mm, further preferably 25 to 30 mm, such as 27 mm.

36. The razor base according to any of the preceding embodiments, wherein the at least one rear extension only protrudes in a width direction with respect to the head portion by 2 to 10 mm, preferably 3 to 7 mm, further preferably 4 to 6 mm, such as 5 mm.

37. The razor base according to any of the preceding embodiments and with the features of embodiments 2 and 11, wherein the central rear extension is curved around a curvature axis generally parallel to an axis of the finger end receiving sections.

38. The razor base according to the preceding embodiment, wherein the curvature tapers along the curvature axis.

39. The razor base according to any of the preceding embodiments and with the features of embodiment 11, wherein the at least one rear extension is the central rear extension.

40. The razor base according to any of the preceding embodiments and with the features of embodiment 25, wherein the at least one rear extension is the lateral rear extensions.

41. The razor base according to any of the preceding embodiments, wherein the razor base has a weight of 8 to 40 g, preferably 10 to 20 g, such as 12 to 15 g.

42. The razor base according to any of the preceding embodiments, wherein the razor base has a maximum extension of less than 80 mm, preferably less than 60 mm, further preferably less than 50 mm in any direction.

43. The razor base according to any of the preceding embodiments with the features of embodiment 2, wherein the razor base comprises 2 finger end receiving sections.

44. The razor base according to any of the preceding embodiments, wherein the razor base comprises an anti-slip material.

45. The razor base according to any of the preceding embodiments with the features of embodiment 3, wherein the razor base is configured to be rigidly connected to the blade unit.

That is, the razor base comprises exactly 2 (and not more) finger end receiving sections.

Below, razor embodiments will be discussed. These embodiments are identified by the letter "R" followed by a number. Whenever reference is herein made to a razor embodiment, these embodiments are meant.

R1. A razor comprising the razor base according to any of the preceding embodiments and the blade unit of embodiment 3.

R2. The razor according to the preceding embodiment, wherein the blade unit is fixedly connected to the head portion.

R3. The razor according to the penultimate embodiment, wherein the blade unit is removably connected to the head portion.

R4. The razor according to any of the preceding razor embodiments, wherein the at least one razor blade is distanced from the rear surface by 3 to 12 mm, preferably 4 to 8 mm, further preferably 5 to 7 mm, such as 6 mm.

R5. The razor according to any of the preceding razor embodiments with the features of embodiment 45, wherein the blade unit is rigidly connected to the razor base.

R6. The razor according to any of the preceding razor embodiments, wherein the blade unit comprises a flushing channel.

R7. The razor according to the preceding embodiment, wherein the flushing channel comprises an opening with a height in the range of 0.1 mm to 2 mm, such as 0.2 mm to 1.5 mm and preferably 0.5 to 1.0 mm.

R8. The razor according to any of the preceding razor embodiments, wherein the blade unit comprises a main portion and two boundary portions and wherein the blade unit surrounds the razor base on at least three sides.

R9. The razor according to any of the preceding razor embodiments, wherein the at least one razor blade in use is distanced from the forward surface of the razor base by a distance not exceeding 5 mm, preferably not exceeding 4 mm, further preferably not exceeding 3 mm, such as 0.1 mm to 1 mm.

Below, razor embodiments will be discussed. These embodiments are identified by the letter "U" followed by a number. Whenever reference is herein made to a use embodiment, these embodiments are meant.

U1. A use of the razor according to any of the preceding razor embodiments, wherein the use comprises shaving.

U2. The use according to the preceding embodiment, wherein the razor base comprises the features of embodiment 2, and wherein during shaving, finger end sections of a user are located in the finger end receiving sections.

U3. The use according to the preceding embodiment, wherein during shaving, the finger end sections are the only sections of the user's fingers contacting the razor.

U4. The use according to any of the preceding use embodiments, wherein the use comprises finger pads of the user being in contact with the rear surface during shaving.

U5. The use according to any of the preceding use embodiments, wherein the use comprises finger nails of the user being in contact with the rear surface during shaving.

U6. The use according to any of the preceding use embodiments, wherein the shaving comprises shaving an armpit and/or a pubic region.

U7. The use according to any of the preceding use embodiments, wherein the razor base comprises the features of embodiment 11, wherein during shaving, the central rear extension is positioned between fingers of the user and wherein during shaving, these fingers contact the central rear extension.

U8. The use according to any of the preceding use embodiments, wherein the use comprises only two fingers contacting the razor during shaving.

U9. The use according to any of the preceding use embodiments, wherein the use comprises only three fingers contacting the razor during shaving.

The present invention will now be described with reference to specific embodiments, which are intended to exemplify, and not to limit, the scope of the present invention.

Figure 1:
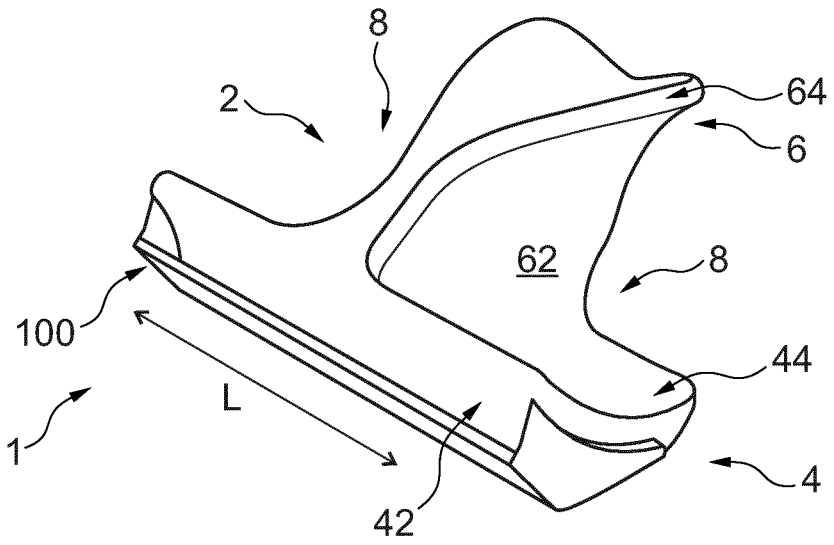
FIG. 1 depicts a razor according to an embodiment of the present invention in a first perspective view.

The Figures depict different perspective views of a razor 1 with a razor base 2 according to embodiments of the present invention. It should be understood that not all drawings comprise all reference signs—instead, individual reference signs have been omitted in some of the drawings for clarity and brevity of illustration. The razor base 2 may also be referred to as base 2, holder 2, support structure 2 or simply support 2. The razor 1 comprises the razor base 2 and a blade unit 100 comprising one or more razor blades. In some embodiments of the present invention, the blade unit 100 may be fixedly connected to the razor base 2, i.e., in such a way that a user may not disassemble the two without a tool. However, in other embodiments of the present invention, the blade unit 100 may also be releasably connected to the razor base 2, i.e., connected to the razor base 2 in such a manner that the two may be readily disconnected from one another by a user. In any case the connection of the blade unit 100 to the razor base 2 may be rigid. That is, independent of whether the blade unit 100 is fixedly connected to the razor base 2 or releasably connected to the razor base 2, the blade unit 100 may be connected rigidly to the razor base 2. A rigid connection is understood to be an unflexible connection, i.e., a connection where the blade unit 100 and the razor base 2 cannot move with respect to one another during use.

The razor base 2 comprises a head portion 4, which may also be referred to as head 4 or razor head 4. The head portion 4 comprises a first main surface 42, which may also be referred to as the forward surface 42, which is configured to be in contact with the blade unit 100 when in use. The head portion 4 also comprises a second main surface 44, which may also be referred to as the rear surface 44. The second main surface 44 is opposite to the first main surface 42. The term forward is herein used to denote that a section is positioned (or configured to be positioned) closer to the blade unit 100 than another section, and the term rear is used herein to denote the direction opposite to the forward direction. In other words, the blade unit 100 is the most forward portion of the razor 1.

It will be understood that the blades of the blade unit 100 generally extend along the first main surface 42, i.e., the blades are parallel to the first main surface 42. The longitudinal direction defined by the blades (i.e., the extension of the blades perpendicular to the intended shaving direction) will be referred to as the longitudinal direction. This longitudinal direction is also indicated by arrow L in FIG. 1. In some embodiments (such as the embodiment depicted in FIG. 1), the razor 1 and the razor base 2 may be mirror symmetric with regard to a symmetry plane. The symmetry plane has a normal vector. This normal vector may also be used to define the longitudinal direction L in embodiments where the razor 1 and the razor base 2 are symmetric.

Figure 5:
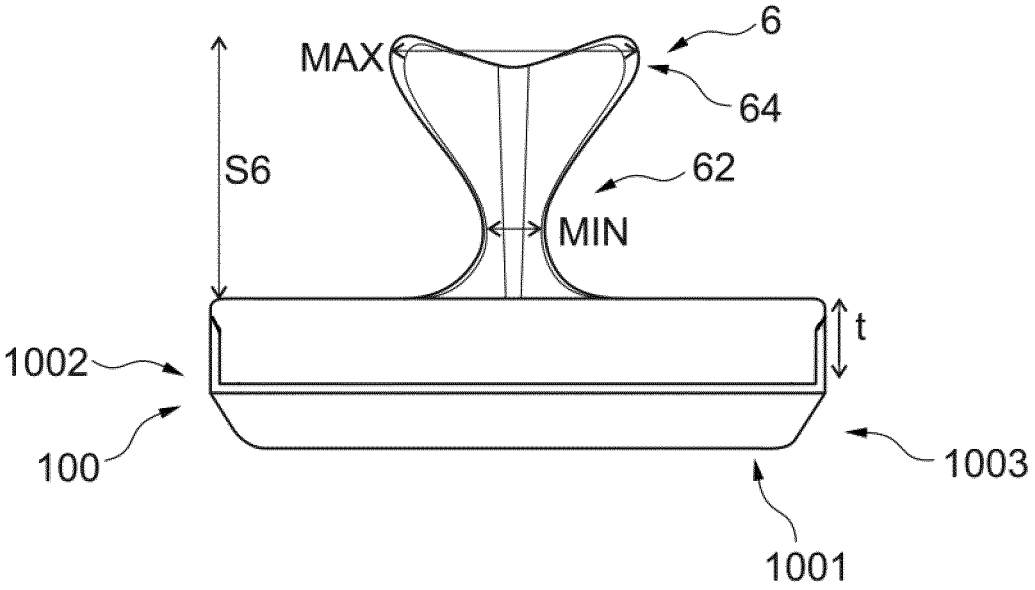
FIG. 5 depicts the razor of FIG. 1 in a still further perspective view.
Figure 6:
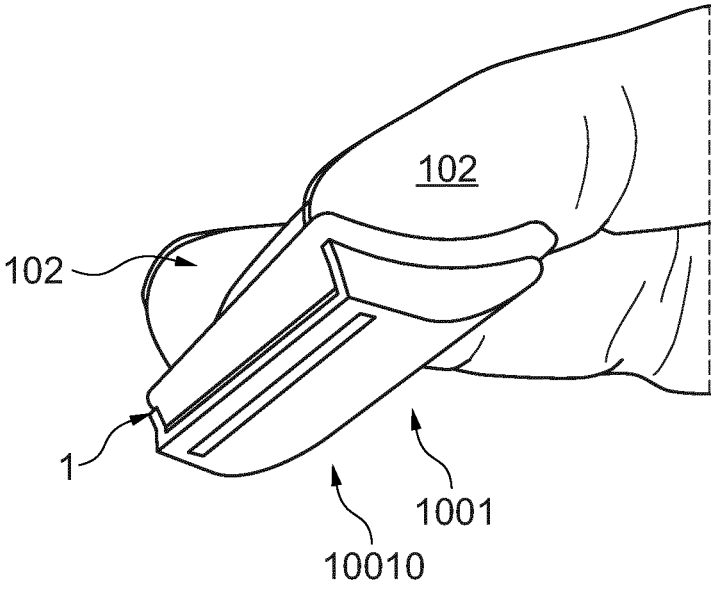
FIG. 6 depicts the use configuration of FIG. 2 in a further perspective view.
Figure 7:
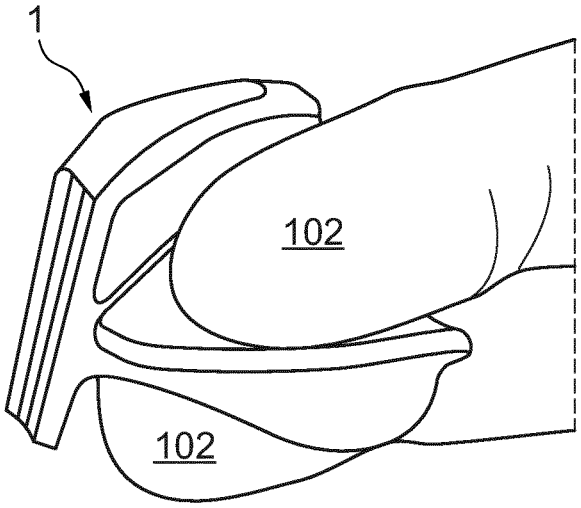
FIG. 7 depicts the razor of FIG. 1 in a further use configuration.

The blade unit 100 comprises a main portion 1001 (see, e.g., FIGS. 5 and 6), which is configured to be in contact with the skin when in use. The main portion 1001 comprises one or more razor blades, extending in the longitudinal direction. The main portion 1001 may be curved, partially or as a whole, to approximate the curvature of the first main surface 42 of the head portion 4. The main portion 1001 may comprise a skin contact surface 10010 configured to be in contact with the skin of a user during use. The blade unit 100 further comprises two boundary portions 1002 and 1003 (see FIG. 5), one at each side of the main portion 1001, perpendicular to the main portion 1001 and extending in the front-to-rear-direction, which may be used to form a rigid connection between the razor base 2 and the blade unit 100. The boundary portions 1002, 1003 may be, partially or fully, wedgelike and/or curved in the width direction of the head portion 4 (i.e. perpendicular to the longitudinal and the front-to-rear direction) to reduce the distance of the skin contact surface 10010 to the first main surface 42 of the head portion 4 in a continuous fashion (such as depicted in FIG. 6 or 7).

Figure 4:
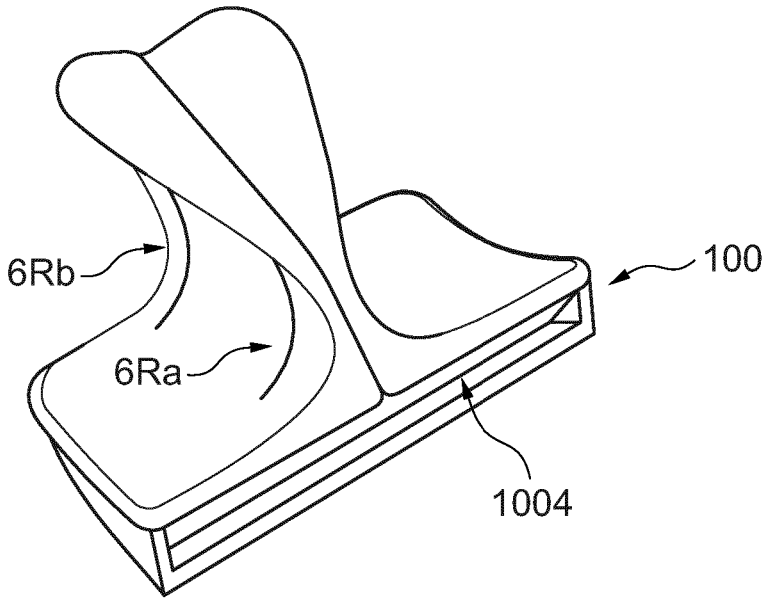
FIG. 4 depicts the razor of FIG. 1 in a still further perspective view.
Figure 12:
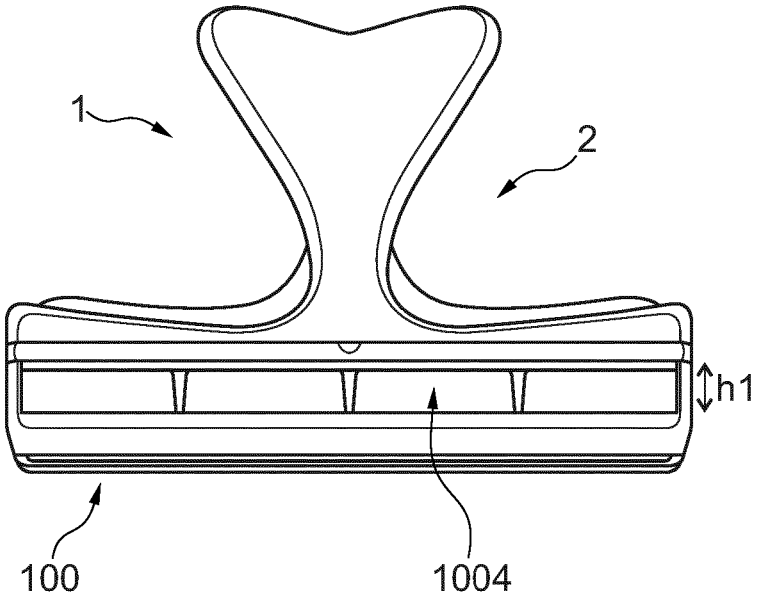
FIG. 12 depicts the razor of FIG. 1 in a front view.

The blade unit 100 may comprise at least one flushing channel 1004 (see, e.g., FIG. 4 and FIG. 12). The flushing channel 1004 may be located between the skin contact surface 10010 of the main portion 1001 and the first main surface 42 of the head portion 4 to flush out hair portion 1001 and the first main surface 42 of the head portion 4 to flush out hair, shaving cream, water and/or any other substances present during the use. The flushing channel 1004 may also be referred to as channel 1004. The channel 1004 comprises one or more openings 1005, which may extend along the longitudinal direction, preferably covering the full length l4 (such as shown in FIG. 12).

The height h1 of the opening of the channel 1004, perpendicular to the longitudinal direction may in the range of 0.2 mm to 2 mm, preferably 0.5 mm to 1 mm.

In other words, the blade unit 100 may comprise a main portion 1001 and two boundary portions 1002, 1003. By means of the main portion 1001 and the two boundary portions 1002, 1003, the blade unit 100 is configured to be connected (preferably rigidly) with the razor base 2 in such a manner that the blade unit 100 surrounds the razor base 2 on at least three sides. In some embodiments, the blade unit 100 may be clipped onto the razor base 2.

It will be understood that the forward surface 42 (see FIG. 1) is generally the portion of the razor base 2 closest to the blade unit 100, and particularly also to the at least one blade of the blade unit 100. In particular, at least one blade of the blade unit 100 may be distanced from the forward surface 42 of the razor base 2 by a distance not exceeding 5 mm, such as not exceeding 4 mm, preferably not exceeding 3 mm, such as 0.1 mm to 1 mm.

The head portion 4 may be curved. In particular, it may be curved around an axis parallel to the longitudinal direction L. A radius of curvature of the second main surface 44 may be 35 mm, though this is merely exemplary. Put differently, the second main surface 44 may be concave.

The razor base 2 further comprises at least one rear extension. The term rear extension may be used interchangeable with the term support extension or support member. In the embodiment depicted in FIG. 1, the at least one rear extension is realized as a central rear extension 6 or central support extension 6. The central support extension 6 extends from the second main surface 44 (i.e. from the rear surface 44) of the head portion 4 and away from the second main surface 44.

Figure 2:
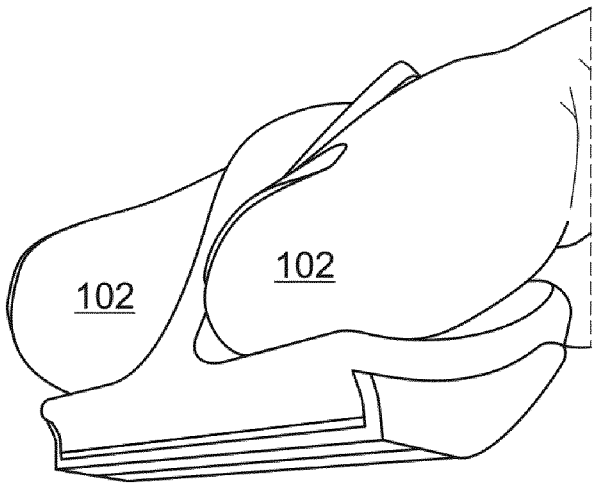
FIG. 2 depicts the razor of FIG. 1 in a first use configuration.

The head 4 and the central support extension 6 together define finger end receiving sections 8, each of which is configured to receive a finger end section 102 when in use, as is exemplarily depicted in FIG. 1. FIG. 2 depicts how finger end sections 102 can be received in these finger end receiving sections 8. The term finger end section 102 herein denotes the section of the finger defined by the distal phalanx, i.e., the section 102 of the finger distal from the distal interphalangeal joint.

As discussed, the central support extension 6 extends away from the rear surface 44 of the head portion.

In particular, the central support extension 6 may have a longitudinal size, i.e., a size parallel to the longitudinal direction L, that varies with the distance to the rear surface 42. This is best depicted in FIG. 5 showing that the central rear extension 6 has a minimal longitudinal size MIN close to the head portion 4 and a maximum longitudinal size MAX close to the rear end of the central rear extension 6.

In other words, the central support extension 6 may also be concave, and in particular, it may be bi-concave, i.e., concave in two directions (e.g., in both the directions defining the finger end receiving sections 8).

In certain embodiments of the present invention (best seen in FIG. 5), the central rear extension 6 may be generally heart-shape, i.e., its shape may resemble the one of a heart. That means that its longitudinal size (with increasing distance from the head portion 4) first decreased until it reaches its minimum MIN and then increases again to a maximum MAX before decreasing again and including, in its extension that is further distanced from the head portion 4, a concave section.

Put differently still, the central rear extension 6 includes sections or walls 62 (see, e.g., FIG. 1) which are at least substantially perpendicular to the longitudinal direction L, i.e., which are at an angle of 80° to 100° with respect to the longitudinal direction. Furthermore, the central rear extension 6 also includes rear sections or rear walls 64 (see, e.g., FIG. 1 and FIG. 5) that substantially deviate from a perpendicular configuration with respect to the longitudinal direction L. Instead, such rear sections or rear walls 64 may have an angle of approximately 60 to 70° with respect to the longitudinal direction L.

Thus, this rear section 64 may also act as an undercut or a rear stop element when the users' fingers are received in the finger end receiving sections 8 (see FIG. 2).

Figure 3:
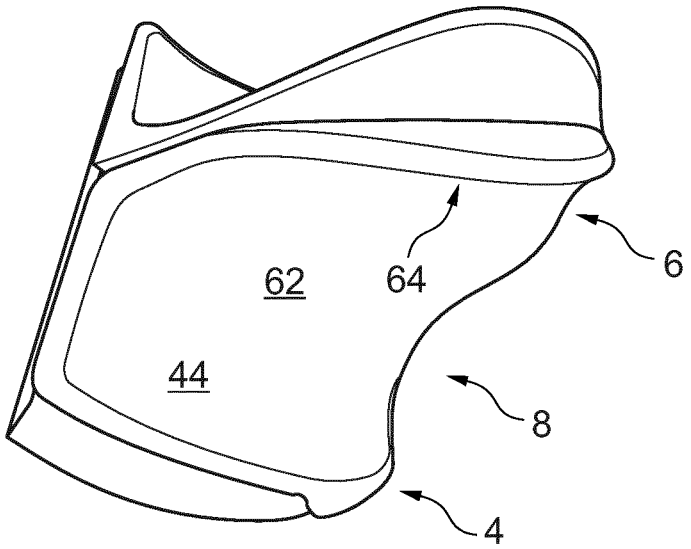
FIG. 3 depicts the razor of FIG. 1 in a further perspective view.

As discussed, the head portion 4 and the central rear extension 6 together define the finger end receiving sections 8, one of which is depicted in full in FIG. 3. The finger end receiving section 8 thus has a forward wall defined by a section of the second main surface 44 of the head portion 4 and a lateral wall defined by section 62 of the central rear extension 6 facing towards the finger end receiving section 8. Furthermore, the finger end receiving section 8 may also have a rear wall defined by the rear section 64 of the central rear extension 6.

Thus, a finger end section 102 received in the finger end receiving section 8 may be supported on at least two sides, and preferably on three sides.

Furthermore, as can also be seen in FIGS. 1 and 3, for example, the finger end receiving sections 8 may narrow in the insertion direction of the fingers, i.e., in the direction defined by the fingers of the user in an in-use configuration. Put differently, the finger end receiving sections 8 may narrow or taper in a finger insertion direction, which finger insertion direction is perpendicular to the longitudinal direction L and perpendicular to a normal vector of the rear surface 44. This open and ergonomic shape of the finger end receiving sections 8 allows the razor base 2 to be suitable for differently shaped and sized fingers, and also different lengths of finger nails.

In use, a user may position his finger end sections 102 in the finger end receiving sections 8 (see FIG. 2), and in particular in such a manner that two of his fingers pads (e.g., the ones of the index finger and the middle finger) engage the rear extension 6.

The user may then use the razor 1 to shave. In particular, the user may bring the razor blade(s) of the blade unit 100 into contact with their skin and may move the razor 1 while it contacts the skin, to thereby shave.

This discussed razor 1 may be different to known razors. One of the advantages is that when shaving with the discussed razor 1, there may be a direct feedback to the finger pads of the user. In particular, the finger pads may be very close to the razor blades of the blade unit 100 when shaving.

For example, the head portion 4 may have a thickness t (see, e.g., FIG. 5) of less than 20 mm, preferably less than 10 mm, such as 2 to 8 mm. Further still, in some embodiments, the razor blades of the blade unit 100 may be positioned at a distance of less than 22 mm, preferably less than 12 mm, such as 4 to 10 mm, from the finger pads of the user when the razor is in use.

This may allow the user to get a very precise feedback when shaving and may allow the user to shave very precisely. This may be particularly advantageous when shaving delicate or hard-to-reach body portions, such as the armpits and the bikini zone.

That is, in other words, embodiments of the present invention provide a razor base 2 or a razor holder 2 having ergonomic receiving sections 8 for at least two fingers, and preferably for the index and the middle finger. The finger pads of the finger end section may be used to supply forces to the razor holder 2 and thus to the body portion to be shaved. As the finger pad is particularly sensitive, this may lead to an improved usability of the discussed razor holder 2.

The configuration depicted in FIG. 1, where the finger pad contacts the rear surface 44 of the head portion 4, may be one preferred use configuration, as the finger pad 102 is a very sensitive area, and may therefore be used to receive feedback during shaving.

Figure 8:
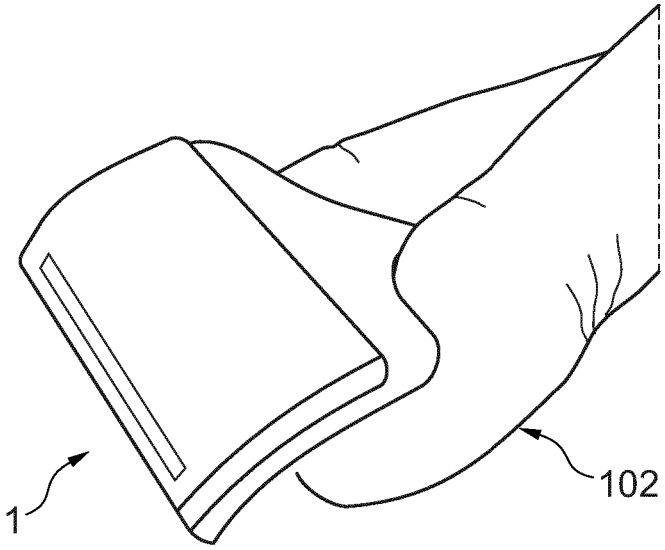
FIG. 8 depicts the use configuration of FIG. 7 in a further perspective view.
Figure 9:
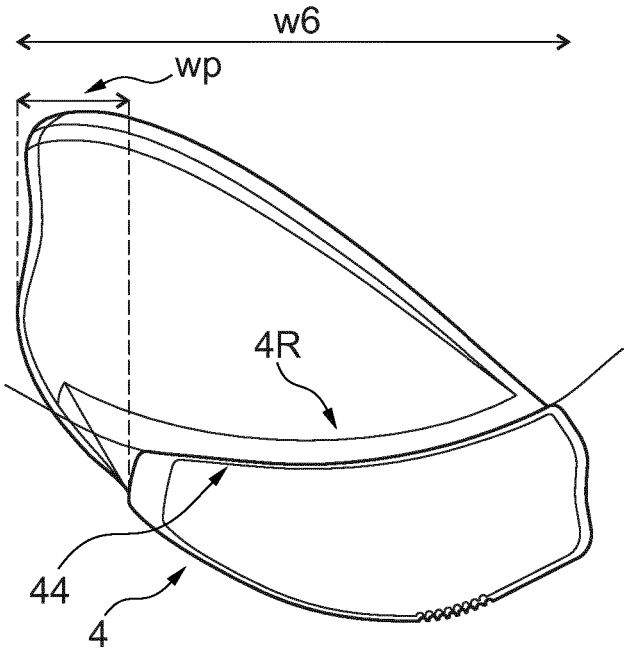
FIG. 9 depicts the razor of FIG. 1 in a side view.
Figure 10:
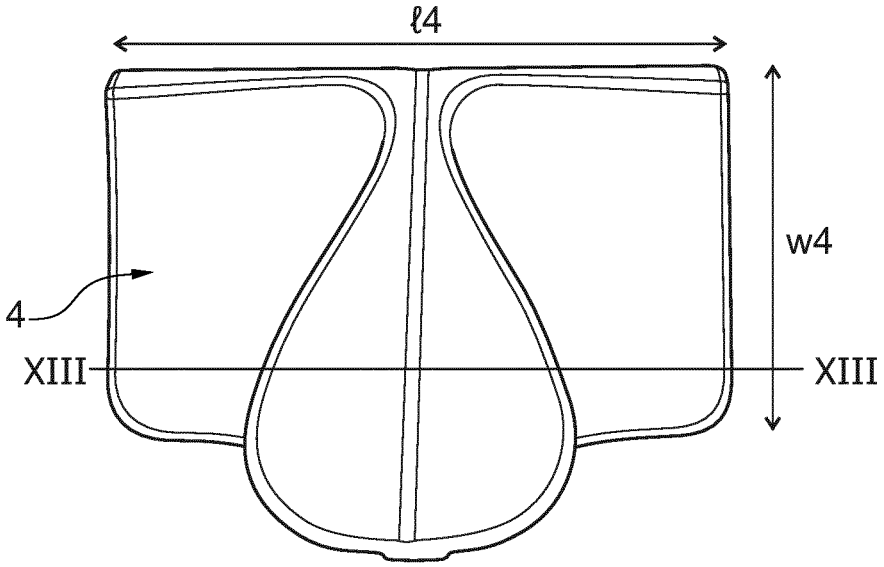
FIG. 10 depicts the razor of FIG. 1 in a top view.

However, this configuration (also depicted in FIG. 6) is not the only configuration in which the discussed razor 1 may be used. In alternative use embodiments, the razor 1 may also be rotated by 180° with respect to the fingers (i.e., around a direction parallel to the longitudinal direction of the fingers)—see FIGS. 7 and 8. In such a configuration, fingernails of the user may contact the rear surface 44. Such a configuration may be advantageous when wanting to shave portions on the body that are hard to reach in the configuration where the finger pads contact the rear surface 44. Furthermore, it may also be used to shave across the grain. It will be understood that the user may also use their thumb to further support the central rear section 6 the razor.

That is, the discussed embodiment provides an ergonomic haptic. As will be understood, only the finger end section 102 of the fingers may contact the razor base 2. Thus, the finger sections contacting the razor base 2 may be moved at the distal interphalangeal joint during shaving in both directions and in a very flexible way. This may lead to a particularly good shaving result. Furthermore, by allowing the finger pads to contact the rear surface 44, a section of the human body being very sensitive and being equipped with a plurality of skin receptors provides the feedback during shaving, which may also be beneficial.

Furthermore, as can be seen, the shaving may be performed by using two fingers (such as the index finger and the middle finger only). Thus, hard-to-reach (and hard-to-see) locations may be shaved and the razor 1 may be used for shaving very small radiuses.

FIGS. 9 to 12 depict further plan side views of an embodiment of a razor 1 in accordance with the present invention. These Figures (but also other Figures) depict exemplary dimensions of a razor 1 or a razor base 2 in accordance with the present invention.

As depicted (see, e.g., FIG. 10), the head portion 4 may comprise a length l4 along the longitudinal direction, which may be 20 to 60 mm, preferably 30 to 50 mm, further preferably 35 to 40 mm, such as 38 mm.

The head portion 4 may also comprise a width w4 perpendicular to the longitudinal direction which may be in the range of 10 to 40 mm, preferably 15 to 30 mm, further preferably 20 to 25 mm, such as 23 mm.

The head portion 4 may also comprise a thickness t (see, e.g., FIG. 5) perpendicular to the longitudinal direction, which may be in the range of 2 to 12 mm, preferably 3 to 7 mm, further preferably 4 to 6 mm, such as 5 mm.

As discussed, the head portion 4 may be curved. In particular, the rear surface 44 of the head portion may be curved around an axis parallel to the longitudinal direction L. More particularly, the rear surface 44 may comprise a radius of curvature 4R (see, e.g., FIG. 9) in the range of 20 to 50 mm, preferably 30 to 40 mm, further preferably 32 to 38 mm, such as 35 mm.

As also discussed, the central rear extension 6 may have a varying size along the longitudinal direction L—see, e.g., FIG. 5. The minimum longitudinal size MIN may be in the range of 1 to 10 mm, preferably 2 to 6 mm, further preferably 3 to 5 mm, such as 4 mm.

Further still, the central rear extension 6 may comprise a size S6 in the front-to-rear direction, i.e., in the direction of the thickness of the head portion 4 (see, e.g., FIG. 5) of 20 to 50 mm, preferably 30 to 40 mm, further preferably 32 to 38 mm, such as 35 mm.

In the width-direction (i.e., perpendicular to the longitudinal direction and to the front-to-rear-direction), the central rear extension 6 may comprise a size w6 of 15 to 40 mm, preferably 20 to 35 mm, further preferably 25 to 30 mm, such as 27 mm.

That is, the central rear extension 6 may only protrude in this direction with respect to the head portion 4 by 2 to 10 mm, preferably 3 to 7 mm, further preferably 4 to 6 mm, such as 5 mm. This dimension may also be referred to as width protrusion wp (see FIG. 9).

Figure 11:
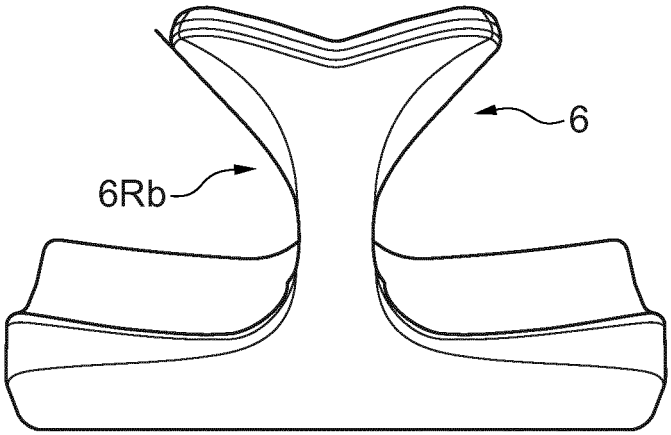
FIG. 11 depicts the razor of FIG. 1 in a rear view.

Still further, the central rear extension 6 may be curved around an axis generally parallel to the fingers (when the finger end sections 102 are inserted). The respective curves are indicated in FIGS. 4 and 11, for example. A radius of curvature may vary along the width direction (defined by the width w4 of the head portion 4). In particular, the curvature may increase the further the finger end section 102 is inserted into the finger end receiving section 8. Further still, as best depicted in FIG. 11, the curvature may also increase the closer a location to the head portion 4.

Exemplary minimal values for a radius of curvature 6Rb of the central rear extension 6 at a first end in the width direction of the razor base 2 are 2 to 6 mm, preferably 3 to 5 mm, such as 4 mm. Exemplary maximal values for a radius of curvature 6Rb of the central rear extension 6 at the first end in the width direction of the razor base 2 are 6 to 15 mm, preferably 8 to 12 mm, such as 10 mm.

Furthermore, at a second end of the width direction of the razor base, exemplary minimal values for a radius of curvature 6Ra of the central rear extension 6 are 2 to 6 mm, preferably 3 to 5 mm, such as 4 mm. Exemplary maximal values for a radius of curvature 6Rb of the central rear extension 6 at the second end in the width direction of the razor base 2 are 4 to 10 mm, preferably 5 to 7 mm, such as 6 mm.

A weight of the razor base 2 may be in the range of 8 to 40 g, preferably 10 to 20 g, such as 12 to 15 g.

Furthermore, a weight of the razor 1 (i.e., razor base 2 with blade unit 100) may be in the range of 10 to 50 g, preferably 15 to 30 g.

Figure 13:
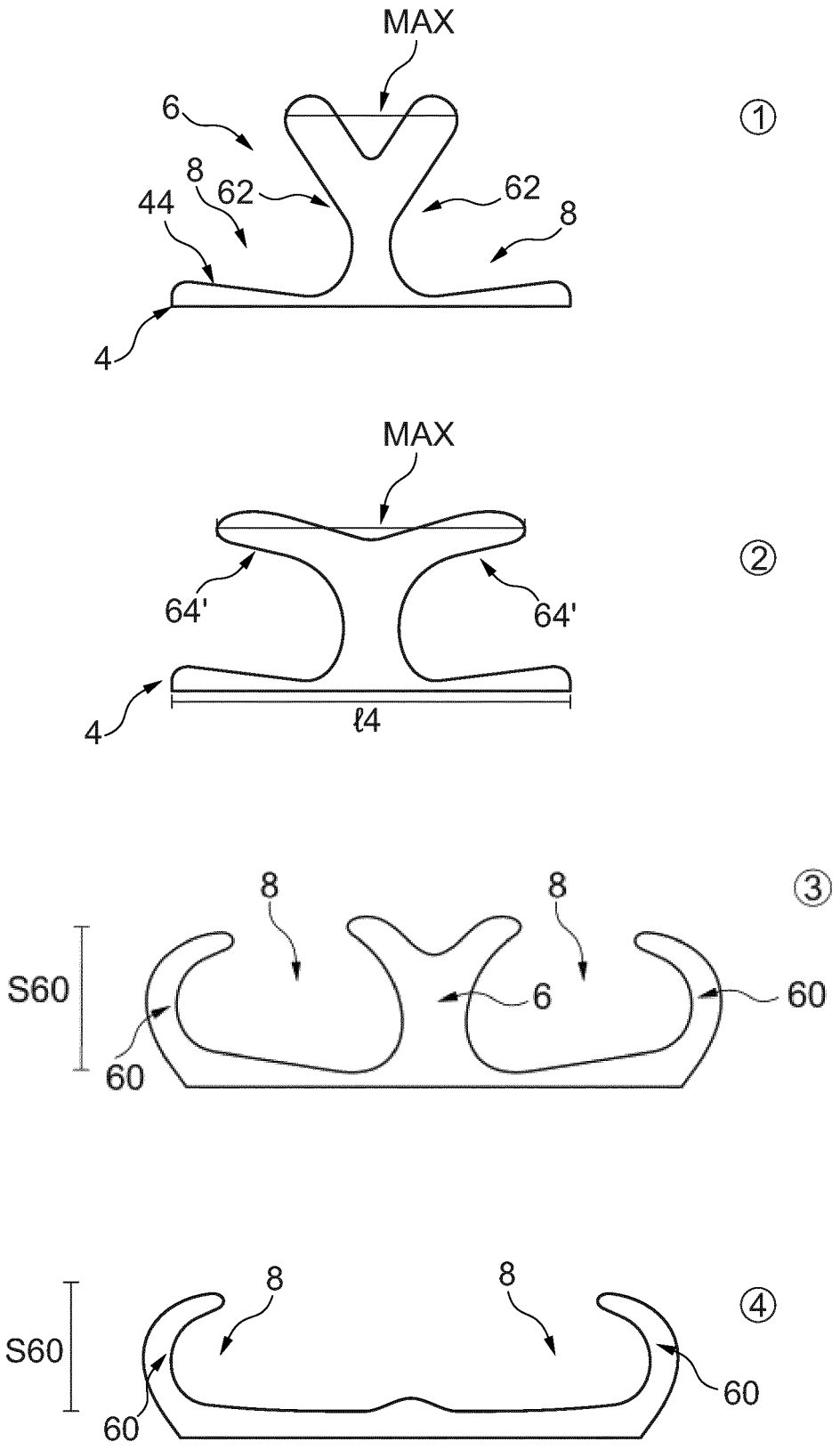
FIG. 13 depicts sections of different embodiments of a razor base.

FIG. 13 depict further cross sections of portions of razor bases 2 of embodiments according to the present invention. More particularly, FIG. 13-1 depicts a cross section of the rear side of the head portion 4 including the rear surface 44 and the central rear extension 6 of the embodiment depicted throughout FIGS. 1 to 12. More particularly, FIG. 13-1 is a cross section along XIII-XIII in FIG. 10.

FIG. 13-1 depicts the finger end receiving sections 8 defined by the rear surface 44 of the head portion 4 and by the central rear extension 6. As discussed, the central rear extension 6 comprises the sections or walls 62 and the rear sections or rear walls 64. In the embodiment depicted in FIG. 13-1, the central rear extension 6 has a general heart shape. The razor base 2 may have any of the dimensions discussed above. Furthermore, the central rear extension 6 may have a maximum longitudinal size MAX (also see FIG. 5) along the longitudinal direction L of 13 to 25 mm, preferably 15 to 20 mm, further preferably 17 to 19 mm, such as 18 mm. It will be understood that the rear extension 4 may generally have a centrally located recess in its rearward section.

FIGS. 13-2 to 13-4 depict alternative embodiments. It should be noted that any of the features discussed above (including the mentioned dimensions) also apply to these embodiments, except for the features and dimensions mentioned below.

The embodiments depicted in FIG. 13-2 greatly corresponds to the embodiment depicted throughout FIGS. 1 to 13-1. However, in the embodiment of FIG. 13-2, the rear walls 64' of the central rear extension 6 have a greater size in the longitudinal direction than the ones discussed before. More particularly, the maximum size MAX of the rear extension 6 in the longitudinal direction may be greater than 50% of the length l4 of the head portion 4 along the longitudinal direction. An exemplary value of the maximum size MAX of the central rear extension 6 in the longitudinal direction L is the range from 25 to 35 mm, preferably 28 to 30 mm, such as 29 mm.

FIG. 13-3 depicts a further alternative embodiment of the present invention. This embodiment comprises a plurality of rear extensions. The rear extensions include a central rear extension 6, which is realized as the ones discussed above with regard to FIG. 1 to 13-1 or 13-2. That is, the central rear extension 6 may comprise any of the features as discussed above.

Furthermore, the rear extensions of FIG. 13-3 also include side rear extensions 60 located on lateral (i.e., longitudinal) sides. Thus, the side rear extensions 60 may also be referred to as lateral rear extensions 60. The lateral rear extensions 60 may comprise a size S60 in the front-to-rear direction (or, put differently, a rearward extension or rearward size) generally corresponding to the front to rear size S6 (see FIG. 5) of the central rear extension 6. That is, S60 may be in the range of 20 to 50 mm, preferably 30 to 40 mm, further preferably 32 to 38 mm, such as 35 mm. The lateral rear extensions 60 may be semi-circular walls.

It will be understood that when used, the lateral rear extensions 60 may also enclose the finger end sections 102 of the user to further secure the user's fingers in the finger end receiving sections 8. Furthermore, it will be understood that the user may engage the central rear extension 6 by pushing together his fingers (e.g., moving the index finger and the middle finger closer to one another). Correspondingly, when the lateral rear extensions 60 are present, the user may also move his fingers, or, more particularly, his finger end sections 102 in an outward direction to thereby engage the lateral rear extensions.

In a further variant depicted in FIG. 13-4, the rear extensions only comprise the lateral rear extensions 60, i.e., there is no central extension 6 present in this embodiment. The lateral rear extensions 60 may again have a rearward size S60 as discussed above. It will be understood that also this embodiment defines finger end receiving sections 8 for receiving finger end sections 102 of a user.

It will be understood that the embodiments relate to a razor 1 or a razor base 2, which is guided by finger end sections 102 of a user. There is an open fit provided, which open fit provides the application of force by the means of at least two finger end sections 102 directly to the blade(s) of the blade unit 100. In some embodiments, the finger end sections are located particularly close to the blades (such as with a distance of 6 mm or less).

Whenever a relative term, such as "about", "substantially" or "approximately" is used in this specification, such a term should also be construed to also include the exact term. That is, e.g., "substantially straight" should be construed to also include "(exactly) straight".

Whenever steps were recited in the above or also in the appended claims, it should be noted that the order in which the steps are recited in this text may be accidental. That is, unless otherwise specified or unless clear to the skilled person, the order in which steps are recited may be accidental. That is, when the present document states, e.g., that a method comprises steps (A) and (B), this does not necessarily mean that step (A) precedes step (B), but it is also possible that step (A) is performed (at least partly) simultaneously with step (B) or that step (B) precedes step (A). Furthermore, when a step (X) is said to precede another step (Z), this does not imply that there is no step between steps (X) and (Z). That is, step (X) preceding step (Z) encompasses the situation that step (X) is performed directly before step (Z), but also the situation that (X) is performed before one or more steps (Y1), . . . , followed by step (Z). Corresponding considerations apply when terms like "after" or "before" are used.

While in the above, a preferred embodiment has been described with reference to the accompanying drawings, the skilled person will understand that this embodiment was provided for illustrative purpose only and should by no means be construed to limit the scope of the present invention, which is defined by the claims.

What is claimed is:

1. A razor comprising a razor base connected to a blade unit, wherein the blade unit comprises a main portion comprising at least one razor blade and wherein said razor base comprises:

a head portion, wherein said head portion comprises a rear surface and a forward surface opposite said rear surface and disposed between said rear surface and said at least one razor blade; and at least one rear extension comprising a central rear extension extending away from said rear surface; wherein said rear surface and said at least one rear extension together define a receiving space so a user may insert a portion of their finger therein;

wherein said central rear extension is curved around a curvature axis generally parallel to an axis passing through said receiving space and wherein the curvature of said central rear extension tapers along the curvature axis so said curvature increases or decreases from one end of said receiving space to an opposite end along said curvature axis;

wherein a portion of said at least one razor blade that is disposed closest to said rear surface is disposed 3 to 12 mm from said rear surface, and wherein the blade unit further comprises at least one flushing channel located between at least one surface of the main portion of the blade unit and the forward surface of the head portion.

2. The razor according to claim 1, wherein said razor base is formed in one part.

3. The razor according to claim 1, wherein said razor base defines a contractible space.

4. The razor according to claim 1, wherein said rear surface is concave and wherein said forward surface is convex.

5. The razor according to claim 1, wherein said at least one razor blade defines a longitudinal direction parallel to the longest surface of said at least one razor blade and wherein said central rear extension has a longitudinal size in said longitudinal direction that varies in dependence of the distance to said rear surface, and wherein said central rear extension comprises a section in which the longitudinal size increases with increasing distance from said rear surface.

6. The razor according to claim 5, wherein the minimum longitudinal size of the central rear extension is within the range of 1 to 10 mm.

7. The razor according to claim 1, wherein said at least one rear extension further comprises lateral rear extensions protruding from said rear surface at opposite ends of said head portion and separated by said central rear extension.

8. The razor according to claim 1, wherein the thickness of said head portion between said front surface and said rear surface is within the range of 2 to 12 mm.

9. The razor according to claim 1, wherein the at least one rear extension only protrudes in a direction away from said head portion by 2 to 10 mm.

10. The razor according to claim 1, wherein said razor base has a maximum extension between any two points thereupon of less than 80 mm in any direction.

11. A method of using a razor according to claim 1, wherein said method comprises shaving, and wherein during shaving, the tips of a user's fingers are disposed within said receiving space.

12. The method according to claim 11, wherein during shaving, the sections of the user's fingers distal from the respective distal interphalangeal joint are the only sections of the user's fingers contacting the razor.

13. The method according to claim 11, wherein said method comprises a portion of said user's fingers being in contact with said rear surface during shaving.

* * * * *